United States Patent [19]

Krebs

[11] Patent Number: 5,053,934

[45] Date of Patent: Oct. 1, 1991

[54] OPTICAL ARRANGEMENT FOR HIGH-POWERED DIAPROJECTORS

[76] Inventor: Jürgen Krebs, Paul-Lincke-Ufer 41, 1000 Berlin 36, Fed. Rep. of Germany

[21] Appl. No.: 477,580

[22] Filed: Feb. 9, 1990

[51] Int. Cl.[5] ..... F21V 17/02

[52] U.S. Cl. ..... 362/281; 362/321; 353/88

[58] Field of Search ..... 362/18, 263, 280, 281, 362/321; 352/204, 207; 357/88, 89, 90, 91, 92, 93; 355/71

[56] References Cited

U.S. PATENT DOCUMENTS

| | | | |
|---|---|---|---|
| 1,885,419 | 11/1932 | Dina | 362/321 |
| 3,307,028 | 2/1967 | Bentham | 362/281 |
| 4,048,493 | 9/1977 | Lee | 362/321 |
| 4,163,277 | 7/1979 | Altman | 362/296 |
| 4,350,417 | 9/1982 | Freeman | 362/321 |
| 4,668,077 | 5/1987 | Tanaka | 355/30 |

FOREIGN PATENT DOCUMENTS

| | | | |
|---|---|---|---|
| 1288907 | 7/1969 | Fed. Rep. of Germany . | |
| 2831926 | 7/1980 | Fed. Rep. of Germany . | |
| 3203800 | 8/1983 | Fed. Rep. of Germany . | |
| 3744060 | 7/1989 | Fed. Rep. of Germany | 362/321 |

*Primary Examiner*—Ira S. Lazarus
*Assistant Examiner*—Richard R. Cole
*Attorney, Agent, or Firm*—Tarolli, Sundheim & Covell

[57] ABSTRACT

An optical arrangement for high-powered projectors has a metal vapor lamp integrated into an ellipsoidal mirror, and an additional mechanical light valve for the continuous control of brightness of the stream of light, and is especially for use in multi-, super-shuttered and large projectors. The compact structure offers high optical efficiency and, at the same time, slight technical expense. The use of this technology makes possible the production of high-powered diaprojectors with small dimensions and light weight.

14 Claims, 3 Drawing Sheets

OPTICAL ARRANGEMENT FOR HIGH-POWERED DIAPROJECTORS

BACKGROUND OF THE INVENTION

1. Technical Field

The invention relates to an optical projection system with a light source and a device for shuttering the light stream of the light source.

2. Background Art

Such projection systems have, especially in the case of high-powered projectors, a light source which is not or is only insufficiently regulable as to the strength of the light stream.

While in conventional projectors equipped with halogen lamps, for example, the light stream of the halogen lamp can be regulated electronically, it is necessary in the case of the metal vapor lamps or xenon high-pressure lamps used for high-powered projectors because of the greater light intensity. It is necessary to install a mechanically working shuttering device in the path of the light beam. For this purpose, it has been proposed, for instance, that the light stream be influenced in the zone of the object (focus) of the projector by a mechanically adjustable Iris shutter. The disadvantage of this arrangement consists, on the one hand, of the damming up of heat generated thereby in the projection object, and on the other hand, of the mechanical complexity of the arrangement.

Alternative continuous shuttering devices are known so-called "gray" or "neutral" wedges which can be rotated or pushed along. In these, a transparent plate is colored increasingly gray in a working (movement) direction, so that in the direction of work it passes in succession from full transparency (no coloring) to complete opacity (completely black), preferably continuously. These gray wedges are arranged as elongated plates or rotatable discs in the path of the beam after the optic projection. The disadvantages of these gray wedges consist, among others, of the fact that they require much space, their direction of movement is mechanically fallible, their maximum speed of movement or maximum frequency with many rapidly varying light-dark changes is relatively small, and the illumination of the object (image) is uneven. This latter occurs because, with halfway tolerable size of the gray wedge, the lighted field is darker on one edge than on the opposite edge. Iris shutters arranged in the focus of projection and gray wedges have in common the further disadvantage that they only provide the desired power in cooperation with a very definite projection object in each case (burning width, lens diameter, etc.), that is, the best possible results for the particular shuttering device used in each case.

As another alternative shuttering device, Venetian louvre type arrangements have been proposed with a plurality of parallel, narrow louvre-type shutters which can swing in common around their longitudinal axes for arrangement in greater cross-sections of light stream. Such devices are less slow, it is true, but extremely sensitive mechanically.

From U.S. Pat. No. 4,668,077 is known an optical projection apparatus for the projecting of patterns for photomasks in which a mercury high-pressure vapor lamp is provided with an elliptical reflector, so that the cone of light produced is first constricted. At the point of constriction, a rotatable shutter projected with openings is placed in the path of the light beam by which the light beam is fully passed through or fully shuttered in strokes. A continuous regulation of brightness of the stream of light is not possible with this.

From German publication 3,203,800 Al is known a test projector for color TV cameras in which a mechanically controlled or regulated shutter is arranged in the cone of light between the lamp provided with a reflector and a first constriction of the light cone. With this shuttering device, the stream of light can be shuttered or released between about 0 and 100 %. In the different shuttering steps, however, the cone of light is influenced asymmetrically which acts against a uniform lighting of the object. To solve this problem in this own arrangement, a light mixing chamber, also known as a diffusor, is arranged in the first constriction point after the lamp. Through this, the asymmetry of the cone of light passing through the shuttering device is equalized. Such diffusors are unsuitable for high-powered projectors because of too great loss of light.

From German publication 1,288,907 is known a shutter for photographic and movie cameras (and thus not for projectors) in which the light stream is generally shuttered by two stationary side-shutter parts to a permanent part. The part of the light cone-field remaining between these two stationary side shutters can be shuttered continuously by a single wedge-shaped movable shutter. For high-powered projectors, the general shuttering out of a part of the light stream is undesirable. The single wedge-shaped shutter used leads also, in some positions, to a non-symmetrical lighting of the object. Moreover, in zones of slight shuttering effect, it has a similar effect to that of the Iris shutter, that is, the available light cone is constricted from the edge which leads to a vignetting of the picture field.

SUMMARY OF THE INVENTION

Starting from this, the invention addresses the problem, in an optical projection system of the kind mentioned, of finding a projection technology arrangement which provides as fully as possible the high light beams of high-powered projectors, especially high-powered diaprojectors, and even exceeding them so far as possible, and also makes possible a continuous mechanical control of brightness at low technical expense.

This problem is solved, according to the invention, by an optical projection system with light source and a device for the shuttering of the stream of light from the light source.

The following advantages, among others, are attained through the invention:

The projectors are smaller and/or lighter than the known high-powered projectors, and for the first time may be used, at reasonable expense, as non-stationary apparatus.

While explosion-protected lamp housings with expensive mirror and adjusting systems are necessary in the known high-powered projection systems, the structure and operation of the projections systems according to the invention are much less expensive.

The shuttering device according to the invention is comparatively simple in mechanical structure, and relatively little sensitive to mechanical influences such as shocks and shaking and high heat stresses.

While in the known metal vapor lamps which are permanently adjusted in an ellipsoidal mirror (for example Osram HTI 24W), only relatively small picture w[illegible]ows, for 16 mm film for example, can be lighted in the projection systems according to the invention. Relatively large picture windows of 4×4 centimeters, for example, can be lighted such as are needed for small picture diaprojectors, while the highest known light streams of high-powered diaprojectors can be reached.

Through the high mobility of the projection systems according to the invention, new possibilities of use for the diaprojectors are provided in many fields of visual and also audio-visual communications.

As to the useful light current as compared with the light wattage of the light source, especially high efficiency is attained.

The light stream is influenced, that is, shuttered, in an especially uniform way, while a uniform (constant) off or on shuttering is attained over the whole cross-section of the object independent of the degree of shuttering.

Relatively few construction parts are used.

Even when changes in light stream are carried out very slowly, the lighting of the object r[illegible]is extremely homogeneous and the off-shuttering (or, of course, the on-shuttering) runs completely uniform and without jumps.

Extremely rapid light stream changes can also be obtained, especially with light streams changing at relatively high frequency.

While conventional high-powered projectors must be provided with their own program controls determined by the special projector and the projection object used for attaining special optical effects, and especially for a program-controlled operation, program controls for the projection systems according to the invention can be taken over, unchanged, from the lower wattage classes. That is, a program control developed for the electronic brightness control of a projection system with a brightness-adjustable halogen lamp may be used directly by means of a suitable cutting point for the program control of a mechanical shuttering device according to the invention, and indeed, even with the use of different projection objects.

The light source with the shuttering device may be produced as an independent construction group and used for the greatest variety of high-powered projectors, that is, substantially independently of the rest of the optical and mechanical devices. This simplifies stockkeeping and adapting to special problems.

Besides the shuttering device, if an aperture shutter is also provided and can be opened and closed through the shuttering device (FIG. 2), light scattering effects are prevented and the movable shutter parts may be designed relatively small.

With the use of ellipsoidal mirrors into which the light source can be integrated, especially high efficiency can be attained. The use of gas discharge lamps has proved especially advantageous, and in particular, the use of metal vapor lamps or gas high pressure lamps such as xenon high pressure lamps.

By the use of heat-resistant material for the parts exposed to the light stream, especially for the movable shutter parts of the shuttering device, the shuttering device may be provided extremely close to the light source. The movable shutter parts may in any case be very thin-walled and thus light and rapid and movable without problems, even when they become so hot from the light source that they are at a red glow. Likewise, the mechanical function of the shutter adjusting device is not impaired, since within the high-heated region no parts in contac[illegible]ith each other are moved relative to each other.

In principle, the number, size and shaping of the teeth of two tooth shutters can be freely chosen within a wide range without impairing the uniform lighting of the object over the whole cross-section. But it is advantageous for the lengths of the projections, or depths of the openings of the tooth shutters to be at least as great as the diameter of the cone of light to be shuttered. With the use of an aperture shutter, the size ratios of the openings of the tooth shutters are attuned to the diameter of the aperture shutter. The number of teeth which cooperate in the cone of light to be shuttered amounts to five according to one preferred embodiment of the invention. An increase or decrease of the number of teeth is possible. However, a decrease may sometimes lead to slight unevenness of the lighting of the object. An increase of the number of teeth is also possible, but leads only, in a certain degree, to a greater equalization of the lighting of the object. In any case, it is more expensive to produce.

In the path of the beam after the light source, there are provided, as a rule, one or more constrictions of the cone of light. Especially with the use of ellipsoidal mirrors, a first constriction of the cone of light is present at a more or less short distance after the light source. The shuttering device according to the invention is advantageously arranged in the zone of constriction next to the light source, and if possible, a little before this constriction. In this way, it is attained that the active shuttering part of the shuttering device is extremely small and thus light and easy to move without the pattern of the partly closed shuttering device being optically imaged. With this preferred arrangement of the shuttering device in the path of the beam, the image of the shuttering device falls in a zone between the lenses of the projection object used near the burning point there.

According to another development of the invention, if a condensor lens system is arranged between the shuttering device and the optic projection, there can be obtained in this way an adapting of the shutter control to the optic projection. These condensor lenses may also be formed non-spherical for better lighting. It is especially preferred for the condensor lense system to be in the path of the beam before the object to be lighted, like the picture window of a diapositive to be lighted.

Projection systems according to the invention are especially suitable for use in multi-, super-shuttered and large projectors. Through the invention, it is possible to influence even high-wattage light sources, which have lamps practically unadjustable electronically, continuously from 0 to 100% in the useful light stream.

It must be understood that the invention is in no way limited to the above embodiments and that many changes may be brought therein without departing from the scope of the invention as defined by the appended claims.

BRIEF DESCRIPTION OF THE DRAWINGS

The invention is explained in detail below from one embodiment with reference to the drawings.

DETAILED DESCRIPTIONS OF A PREFERRED EMBODIMENT

Figure 1:
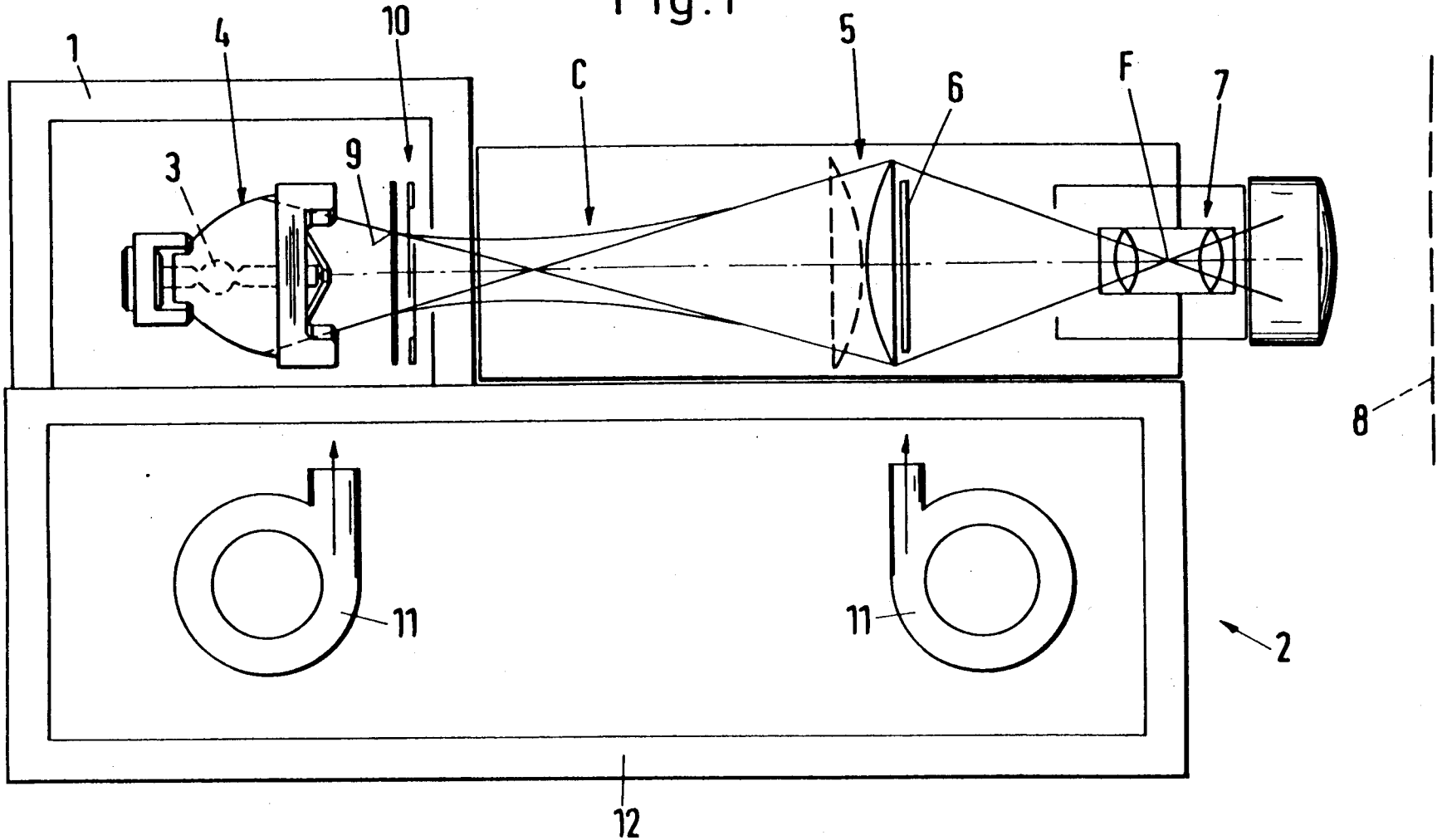
FIG. 1 is a schematic representation of the path of the light beam of an optical projection system according to the invention, applied in a small picture diaprojector, as viewed from above.

In a lamp housing 1 of a small picture diaprojector unit 2 is a discharge lamp 3 which may be, for example, a metal vapor lamp, and in the example shown, is one of the type Osram HTI 24W integrated within an ellipsoidal mirror 4 and firmly adjusted. The light cone C produced by it is constricted a relatively short distance after the light source 3, and then broadens again. At a suitable point after the first constriction, a condensor lens system is provided. Directly after this is the plane of the object, and in this case, the picture window 6 of a diapositive. Through the condensor lens system 5, the bundle of light is focused into a burning spot F which is, at the same time, the inner burning spot of a projection object 7 which provides for the imaging of the object on a projection wall 8, shown in broken line, which of course is arranged at a much greater distance than represented.

Figure 2C:
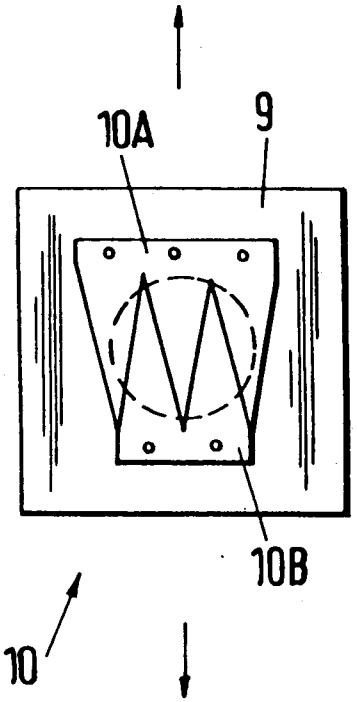
FIGS. 2*a*–2*c* is a frontal view of a shutter according to the invention, in schematic representation, in three different work positions (as viewed opposite the light source)
Figure 2B:
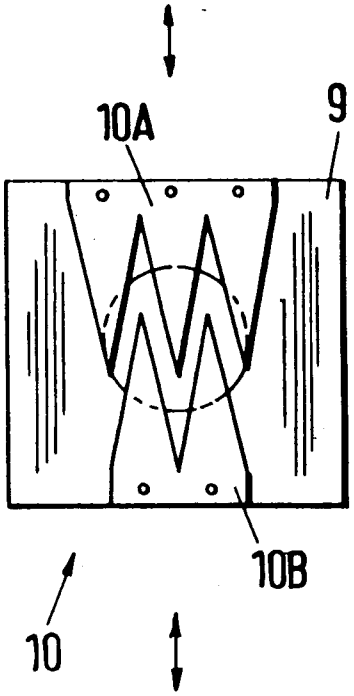
Figure 2A:
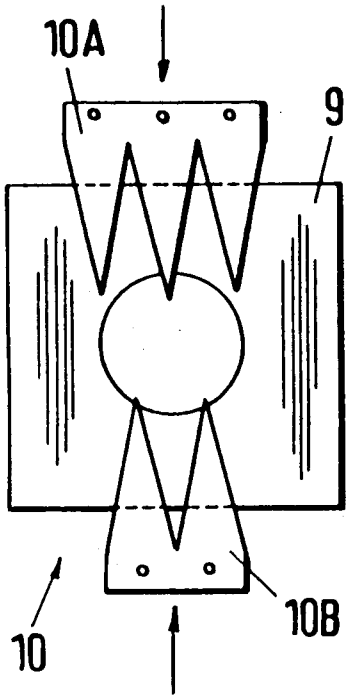

An aperture shutter 9, circular in this view, is inserted between the discharge lamp 4 and the first constriction of the stream of light. (See also FIG. 2*a*-*c*). At a short distance after this is a shutter device 10 which can be introduced into the path of the light beam. This consists of two tooth shutters 10A and 10B with a total of five wedge-shaped teeth in the form of wedge-shaped projections with wedge-shaped openings between them. The surfaces of the projections and openings (hollows) are congruent. Both tooth shutters 10A and 10B are continuously movable relative to each other, so that in each case the projections of the one shutter part can be introduced into the openings of the other shutter part. In FIG. 2*a*, the aperture shutter 9 is almost completely freed of the movable shutter parts 10A and 10B, and in FIG. 2*c* completely closed. An intermediate position is shown in FIG. 2*b*. As can be seen, light passes from all cross-sectional zones of the aperture shutter 9 through the shuttering devices 10, that is, both in zones near the edge and far from the edge, without there being any zones of which the lighting is especially marked or especially poor. The directions of movement of the shutter parts 10A and 10B are represented as arrows in FIG. 2*a*-2*c*.

As can be seen further from FIG. 1, the two movable shutter parts 10A and 10B lie in two planes in the path of the light beam, one after the other, so that a clamping is prevented.

The opening and closing of the tooth shutters 10A, 10B, which are made of heat-resistant material and very light in weight, can be done by suitable linear or rotary movements magnetically, by electric motor, or pneumatically, which in turn, may be controlled by electronic programming devices.

Although the shuttering device 10 consists of heat-resistant material, it is well to arrange at least one blower 11 so that the stream of air coming out provides at least the discharge lamp 3 and the aperture shutter 9 or the shutter device 10 with cooling air. In the example of FIG. 1, two blowers 11 are shown schematically in a housing 12 holding the whole arrangement.

Figure 3C:
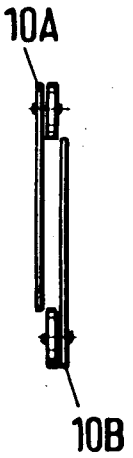
FIGS. 3*a* -3*c* illustrate a simple device for the opening and closing of toothed shutters.
Figure 3A:
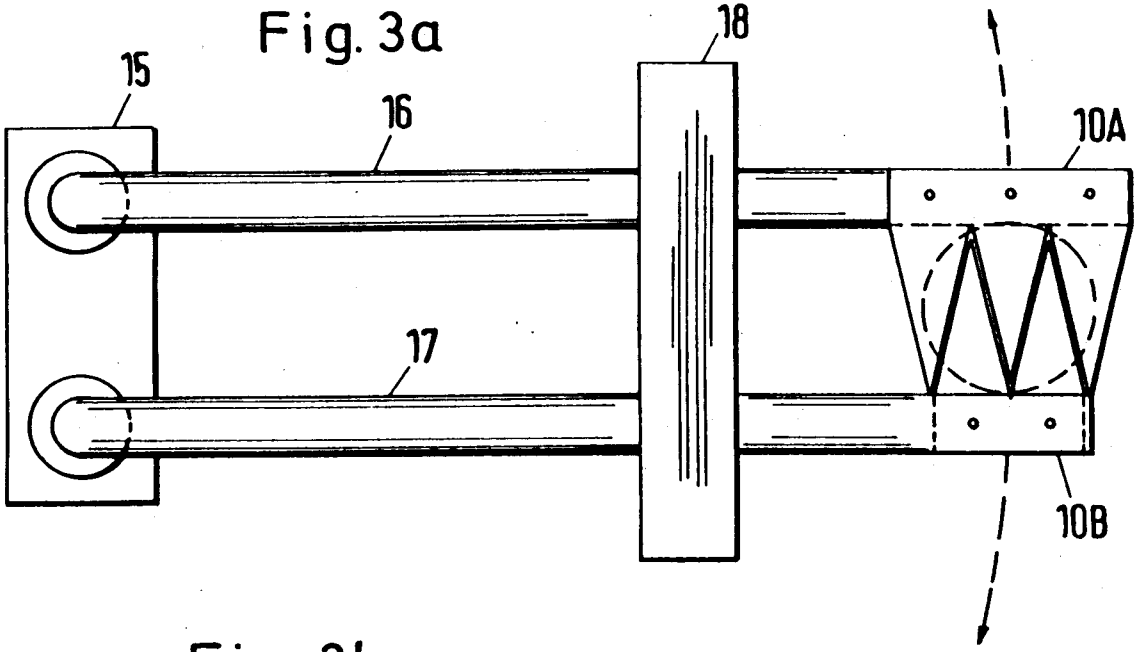
Figure 3B:
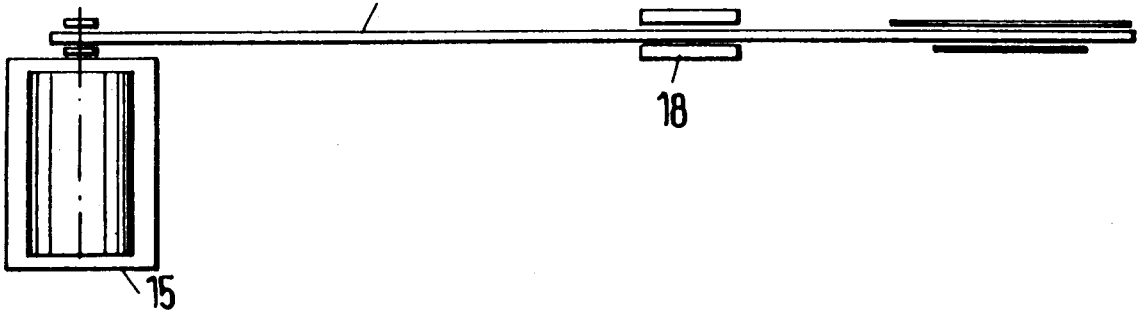

As shown in FIGS. 3*a*-3*c*, an actuatable drive 15 is provided for the opening and closing of the tooth shutters 10A, 10B. An arm 16 is operatively connected between the drive 15 and the tooth shutter 10A. Another arm 17 is operatively connected between the drive 15 and the tooth shutter 10B. A slide guide 18 located between the drive 15 and the tooth shutters 10A, 10B guides each of the arms 16, 17 in sliding movement. When the drive 15 is actuated, the arms 16, 17 slide relative to the slide guide 18. The sliding movement of the arms 16, 17 relative to the slide guide 18 effects movement of the tooth shutters 10A, 10B relative to each other to thereby open and close the tooth shutters 10A, 10B.

Having described a preferred embodiment of the invention, I claim:

1. An optical projection system with a light source (3), said optical projection system comprising:

a shuttering device (10) for the shuttering of a cone of light from the light source;

the shuttering device including only two shutter parts (10A, 10B) continuously movable across the cone of light and relative to each other and being tooth shutters; and each of the shutter parts including spaced apart projections, the projections on one shutter part being introduceable into openings between the projections in the other shutter part.

2. A projection system according to claim 1, distinguished by an aperture shutter (9) which can be closed by the shuttering device (10).

3. A projection system according to claim 1 with the distinction that the light source (3) is integrated into an ellipsoidal mirror.

4. A projection system according to claim 1 with the distinction that the light source (3) is a gas discharge lamp.

5. A projection system according to claim 4, with the distinction that the gas discharge lamp is a xenon high pressure lamp.

6. A projection system according to claim 1 with the distinction that the shutter parts (10A, 10B) of the shuttering device (10) consist of heat-resistant material.

7. A projection system according to claim 1 with the distinction that one or more constrictions of a cone of light are provided after the light source (3), and that the shuttering device (10) is arranged in a zone of, and especially before, the constriction closest to the light source (4).

8. A projection system according to claim 1 with the distinction that a condensor lens system (5) is arranged between the shuttering device (10) and an optic projection (7).

9. A projection system according to claim 8, with the distinction that the condensor lens system (5) is arranged before a picture window (6).

10. A projection system according to claim 1 with the distinction that the projection system is designed as a high-powered projector, especially for use in multi-, super-shuttered and large projectors.

11. A projection system according to claim 1 with the distinction that the tooth shutters have five mutually engaging teeth in a zone of a cone of light, especially wedge-shaped teeth.

12. An optical projection system with a light source (3), said optical projection system comprising:

a shuttering device (10) for the shuttering of a cone of light from the light source;

the shuttering device including two shutter parts (10A, 10B) continuously movable across the cone of light and relative to each other and being tooth shutters; and each of the shutter parts including a number of spaced apart projections, the projections on one shutter part being introduceable into openings between the projections in the other shutter part, each projection having a length at least as great as a diameter of the cone of light, each opening having a depth at least as great as the diameter of the cone of light.

13. An optical projection system comprising:

means for producing a converging cone of light;

a shuttering device for regulating the intensity of the cone of light;

said shuttering device including two shutter parts continuously movable across the cone of light and relative to each other and being tooth shutters; and each of the shutter parts including a number of spaced apart projections, the projections on one shutter part being introduceable into openings between the projections in the other shutter part, each projection having a length not substantially less than the diameter of the cone of light received by the shuttering device, each opening having a depth not substantially less than the diameter of the cone of light received by the shuttering device.

14. An optical projection system comprising:

means for producing a beam of light having a transverse dimension;

a shuttering device for regulating the intensity of the beam of light;

said shuttering device including only two shutter parts continuously movable across the beam of light relative to each other and being tooth shutters; and each of the shutter parts including a number of spaced apart projections, the projections on one shutter part being introduceable into openings in the other shutter part, the projections blocking portions of the beam of light as they move across the beam of light to a position totally blocking the beam of light and defining a zig-zag area for light to pass beyond the projections with the zig-zag area extending entirely across the beam of light prior to the projections totally blocking the beam of light.

* * * * *